US008943625B2

(12) United States Patent
Gotel et al.

(10) Patent No.: US 8,943,625 B2
(45) Date of Patent: Feb. 3, 2015

(54) ERGONOMIC BABY SWADDLING BLANKET

(71) Applicant: The ERGO Baby Carrier, Inc., Los Angeles, CA (US)

(72) Inventors: Daruni M. Gotel, Makawao, HI (US); Rodney V. Telford, Kula, HI (US); Carol J. Lubick, Kula, HI (US)

(73) Assignee: The ERGO Baby Carrier, Inc., Los Angeles, CA (US)

( * ) Notice: Subject to any disclaimer, the term of this patent is extended or adjusted under 35 U.S.C. 154(b) by 0 days.

(21) Appl. No.: 13/918,589

(22) Filed: Jun. 14, 2013

(65) Prior Publication Data

US 2013/0333113 A1 Dec. 19, 2013

Related U.S. Application Data

(60) Provisional application No. 61/660,497, filed on Jun. 15, 2012, provisional application No. 61/728,493, filed on Nov. 20, 2012.

(51) Int. Cl.
*A41B 13/06* (2006.01)

(52) U.S. Cl.
CPC ..... *A41B 13/065* (2013.01)
USPC ..... 5/494; 2/69.5

(58) Field of Classification Search
CPC ..... A41B 13/06; A41B 13/065; A47G 9/083
USPC ..... 5/655, 485, 494; D6/603; 2/69.5; D2/719
See application file for complete search history.

(56) References Cited

U.S. PATENT DOCUMENTS

| | | | | |
|---|---|---|---|---|
| 4,467,945 | A * | 8/1984 | Schaapveld | 224/160 |
| 4,964,858 | A | 10/1990 | Livny | |
| 5,722,094 | A * | 3/1998 | Ruefer | 2/69.5 |
| 6,499,165 | B1 * | 12/2002 | Morgillo | 5/655 |
| 6,640,340 | B2 | 11/2003 | Gibson | |
| 6,868,566 | B2 | 3/2005 | Gatten | |
| 6,928,674 | B2 | 8/2005 | Blackburn | |
| D513,357 | S | 1/2006 | Allard | |
| 7,254,849 | B1 | 8/2007 | Fiebrich et al. | |
| 7,587,769 | B1 | 9/2009 | McDermott | |
| 7,681,261 | B1 | 3/2010 | O'Neil | |
| D613,106 | S | 4/2010 | Ward et al. | |
| 7,774,875 | B1 | 8/2010 | Zeidman | |
| 7,954,187 | B1 * | 6/2011 | Earnest | 5/494 |
| 7,997,465 | B2 | 8/2011 | Garofalo et al. | |
| 8,011,037 | B1 | 9/2011 | Earnest | |

(Continued)

FOREIGN PATENT DOCUMENTS

JP 2008-255533 10/2008

OTHER PUBLICATIONS

Truewomb, LLC—Executive Summary, Nov. 2011, 1 page.

(Continued)

*Primary Examiner* — Nicholas Polito
(74) *Attorney, Agent, or Firm* — Sprinkle IP Law Group

(57) ABSTRACT

A swaddling blanket for maintaining a baby in an ergonomic position. One embodiment can include features for positioning the baby's arms in pockets in first and second arm wings and wrapping the arm wings. An embodiment may also include features for positioning the baby's hips in a hip positioning portion and bringing a hip positioning flap into a position to encourage the baby's legs to an ergonomic position.

18 Claims, 11 Drawing Sheets

(56) References Cited

U.S. PATENT DOCUMENTS

| | | | | |
|---|---|---|---|---|
| 8,032,958 | B2 | 10/2011 | Pieta et al. | |
| 8,042,869 | B2 * | 10/2011 | McClintock et al. | 297/219.12 |
| 8,127,385 | B1 * | 3/2012 | Goutevenier | 5/655 |
| 8,695,133 | B2 * | 4/2014 | Christensen et al. | 5/494 |
| 2004/0019969 | A1 | 2/2004 | Gatten | |
| 2009/0282599 | A1 | 11/2009 | Comerford | |
| 2010/0257653 | A1 * | 10/2010 | Pitts | 2/69.5 |
| 2010/0275373 | A1 | 11/2010 | Kaplan et al. | |
| 2011/0099719 | A1 | 5/2011 | Hardesty | |
| 2011/0179546 | A1 | 7/2011 | Millette et al. | |
| 2011/0231993 | A1 | 9/2011 | Schmid et al. | |
| 2012/0284922 | A1 * | 11/2012 | Gangan et al. | 5/494 |

OTHER PUBLICATIONS

International Search Report and Written Opinion issued in PCT Application No. PCT/US2013/045960, mailed on Nov. 7, 2013, 10 pages.

* cited by examiner

ERGONOMIC BABY SWADDLING BLANKET

RELATED APPLICATIONS

This application claims priority under 35 U.S.C. 119(e) to U.S. Provisional Patent Application Nos. 61/660,497, filed Jun. 15, 2012, entitled "ERGONOMIC BABY SWADDLING BLANKET," by Daruni M. Gotel, Rodney Telford, and Carol J. Lubick, and 61/728,493, filed Nov. 20, 2012, entitled "ERGONOMIC BABY SWADDLING BLANKET," by Daruni M. Gotel, Rodney Telford, and Carol J. Lubick, both of which are fully incorporated by reference herein.

TECHNICAL FIELD

Embodiments relate to baby care products. Even more particularly, embodiments relate to swaddling blankets for swaddling babies.

BACKGROUND

Swaddling blankets are used to keep babies feeling safe and secure, while providing warmth and protection to the baby and making the baby more manageable for the caregiver. The traditional method of swaddling a baby involves wrapping the baby in a rectangular blanket, binding the baby's legs and arms. Swaddling babies is not foolproof. If the baby's arms are not secured or inadequately secured, the baby might have a startle reflex or wiggle or otherwise work her/his arms free, which can wake the baby. Additionally, caregivers may have a difficult time correctly swaddling a moving baby using a rectangular blanket.

A number of swaddling devices have been developed in an attempt to make swaddling easier. Many of these devices suffer similar shortcomings in that they bind the baby's arms to the baby's side, bind the baby's legs together and/or bind the baby's legs and arms in a single swaddle that makes it difficult to uncover the baby's legs (e.g., for diaper changes, cooling) without the baby's arms becoming unswaddled.

Some prior approaches restrict the baby's arms in an unnatural position to the side of the body or behind the body. Such a position is uncomfortable and can cause the baby to wake. Moreover, pinning the baby's arms to the side or behind the body does not guarantee that the baby cannot work her/his arms free, which can also be uncomfortable for the baby. Additionally, the technique used to bind the baby's arms to his/her sides using a traditional swaddling blanket may result in the baby's legs being restricted and unable to fully spread.

In addition to securing the arms of a baby, swaddling techniques may involve securing the legs of the baby as well. For example, approaches to swaddling a baby's legs may involve wrapping the legs together in a blanket, placing the legs inside a bag, sac or the like. Such approaches, however, do not promote keeping the baby's hips and legs in the proper ergonomic spread position but rather often keep the baby's hips and knees in an extended position which may increase the risk of hip dysplasia and dislocation.

Furthermore, in many current swaddling devices, the legs and arms are treated together so that the lower body cannot be unswaddled without also loosening the upper body. Consequently, diaper changes and the like may require completely reswaddling the baby.

SUMMARY OF THE DISCLOSURE

Embodiments of a swaddling blanket may be configured to provide a sense of security and comfort for a baby or small child while providing ergonomic positioning for the baby's thighs and hips and securing the baby's arms in a desired position. According to some embodiments, the arms can be swaddled independently of providing proper hip and leg positioning. Moreover, the lower body can be covered independently of providing proper hip and leg positioning and swaddling of the baby's torso.

One embodiment of a swaddling blanket includes a middle section having a torso portion and a hip and/or positioning section, a first arm wing extending a first direction from the middle section, a second arm wing extending a second direction from the middle section and a hip positioning flap extending from the hip section, configured to encourage a baby to an ergonomic position when in use by lifting and separating the baby's thighs. A swaddling blanket may also include a leg pouch to cover a baby's legs.

The first arm wing can be adapted to wrap around the baby and the second arm wing can be adapted to wrap over the first arm wing. The second arm wing may include a securing mechanism to secure to the back of the swaddling blanket. The hip flap may include a securing mechanism to allow the hip flap to be secured to the swaddling blanket. According to one embodiment, the hip positioning flap can be adapted to secure to the back of the second arm wing independent of securing the second arm wing.

The hip positioning flap may include a portion that is wider than the baby's hips along a portion of the baby's thighs and can be adapted to wrap up between the baby's legs. For example, the hip positioning flap may secure to the back surface of the second wing. The hip positioning flap may comprise areas of increased padding. By way of example, the hip positioning flap may comprise a first area of increased padding at a first edge of the hip positioning flap in a first thigh contact area and a second area of increased padding at a second edge of the hip positioning flap in a second thigh contact area.

The hip positioning flap or other positioner can be adapted to keep the baby's legs in a desired ergonomic spread squat position, such as an ergonomic "frog leg" position to promote healthy hip development. Furthermore, the baby's legs can be in a position where they are not secured straight down or pressed together, which allows the baby to be secured in a baby carrier or similar product, and may prevent or at least reduce the risk of hip dysplasia or dislocation. The hip positioning flap may be unsecured independent of the arms, allowing for easier diaper changes.

A swaddling blanket may include a leg pouch. According to one embodiment, the leg pouch may be joined to the back surface of the swaddling blanket. The pouch may be attached where the opening to the pouch is obstructed when the hip flap is in an unsecured (down position) but is accessible when the hip flap is in a secured position. The pouch can be adapted to receive the baby's legs. The leg pouch can be configured to allow the baby's legs to be uncovered without reducing the integrity of the arm swaddle.

A swaddling blanket may include a first pocket disposed on the first wing and a second pocket disposed on a second wing. The first pocket may have a first pocket opening at a medial end of the first pocket and the second pocket may have a second pocket opening at a medial end of the second pocket. The first pocket can be adapted to receive a first arm and the second pocket adapted to receive a second arm. According to one embodiment, the first and the second pockets can be positioned so that the baby's fists rest over the baby's chest when the infant is new born with the right fist secured to the right side of the baby and the left fist secured to the left side of the baby, allowing a 'Hand-to-Heart' position. As the baby grows bigger, embodiments allow the baby to progress into the full arm pockets, having his/her arms fully extended inside the length of the arm sleeves. When arm wings are folded over closed, the second arm is positioned just above the first arm, both the arms are folded over/across the chest in a 'hugging' position. In other words, the arms are not positioned on top of each other. Instead, one arm rests above the other.

A swaddling blanket may also include a first arm flap proximate to the first pocket opening and a second arm flap proximate to the second pocket opening. The first arm flap can include a first arm flap first portion having a back surface facing a front surface of the first arm wing such that the first arm passes between the first arm flap first portion and the front surface of the first wing when the first arm is received in the first pocket. The first arm flap may also include a first arm wrap portion extending from the first arm flap first portion, the first arm wrap portion adapted to tuck under a portion of the first arm when the first arm is received in the first pocket. The first arm wrap may be adapted to provide a gentle force on the first arm upward and toward the distal end of the first pocket.

A swaddling blanket may also include a second arm flap proximate the second pocket opening. The second arm flap can include a second arm flap first portion having a back surface facing a front surface of the second arm wing such that the second arm passes between the second arm flap first portion and the front surface of the second wing when the second arm is received in the second pocket. The second arm flap may also include a second arm wrap portion extending from the second arm flap first portion. The second arm wrap portion can be adapted to tuck under a portion of the second arm when the second arm is received in the second pocket. The second arm wrap may be adapted to provide a gentle force on the second arm upward and toward the distal end of the second pocket. According to one embodiment, the arm wrap portions of the first and second arm flaps tuck under the baby's arms to at least partially wrap a portion of the baby's arms above the elbow.

A first secondary panel can be provided, the first secondary panel having a first secondary panel back surface facing a main panel front surface. The first secondary panel may form the first pocket in cooperation with the main panel. The first secondary panel may also form the second pocket in cooperation with the main panel. The first arm flap and second arm flap may comprise portions of the first secondary panel.

A second secondary panel may be provided, the second secondary panel back surface facing the main panel front surface. The second secondary panel may form the second pocket in cooperation with the main panel. The first arm flap may comprise a portion of the first secondary panel and the second arm flap may comprise a portion of the second secondary panel.

Some embodiments allow a baby's arms to be positioned and secured individually, independent of the legs. The baby's arms can be positioned individually in arm pockets. The arm pockets can ensure the baby's arms are secured in a desired orientation, such as to replicate the fetal arm position. An advantage to arm pockets may also be that there is no or less excess fabric, which could come loose or get bunched up under the baby, forcing the baby into an unnatural position.

Embodiments disclosed herein provide an ergonomic swaddling blanket to allow a baby to be covered and safe. Embodiments provide structured sleeves/pockets that gently secure arms in place in a position/configuration that imitates the position when the baby was still in the womb. The baby's arms can be positioned in a variety of bent arm positions. Embodiments also provide hip positioning that allows natural leg movements (rather than binding the legs together).

One embodiment may include a method for swaddling a baby, the method comprising positioning the baby in a swaddling blanket where the baby's hips are positioned relative to a hip portion and the swaddling blanket has a first arm wing and a second arm wing. The first arm wing may extend in a first direction from the middle section and the second arm wing may extend in a second direction from the middle section.

The method may further include wrapping the first arm wing and second arm wing around the baby and securing at least one of the arm wings to swaddle the baby's arms. The method may further include advancing a hip positioning flap through the baby's legs to bias the baby's legs into a desired position and securing the hip positioning flap to position the baby's legs after the baby's arms are swaddled. The method may further include covering the baby's legs with a pouch after the hip positioning flap is secured. In some cases, the baby's legs may be uncovered and hip positioning flap unsecured without the swaddle of the baby's arms being unsecured.

In some embodiments, a first arm may be advanced into a first pocket of the first arm wing and a second arm may be advanced into a second pocket of the second arm wing prior to wrapping the first arm wing and second arm wing. A portion of the first arm may be wrapped with a first arm flap and a portion of the second arm with a second arm flap prior to wrapping the first arm wing and second arm wing.

According to one embodiment, securing at least one of the arm wings can include securing a first securing mechanism on the first arm wing to a second securing mechanism on a torso portion of the swaddling blanket. It may also include securing a third securing mechanism on the second arm wing to a fourth securing mechanism on the ergonomic swaddling blanket. The fourth securing mechanism may be on the torso portion or elsewhere. Securing the hip positioning flap may comprise securing the hip positioning flap to one of the arm wings.

The method may further comprise positioning the baby's head into a hood integral to the middle section of the swaddling blanket. The hood may be at least partially formed by a secondary panel that also forms a portion of the one or more of the first and second pockets. Wrapping the first arm wing around the baby and wrapping the second arm wing around the baby may reduce gaping near the baby's neck.

Embodiments provide an advantage by allowing for independent (i) securing of arms/torso and (ii) proper positioning of the legs and hips, but in a unitary design. Embodiments may further allow independent covering the baby's legs in a unitary blanket.

BRIEF DESCRIPTION OF THE DRAWINGS

For a more complete understanding of the present disclosure and the advantages thereof, reference is now made to the following description taken in conjunction with the accompanying drawings in which like reference numerals indicate like features and wherein.

DETAILED DESCRIPTION

Figure 1:
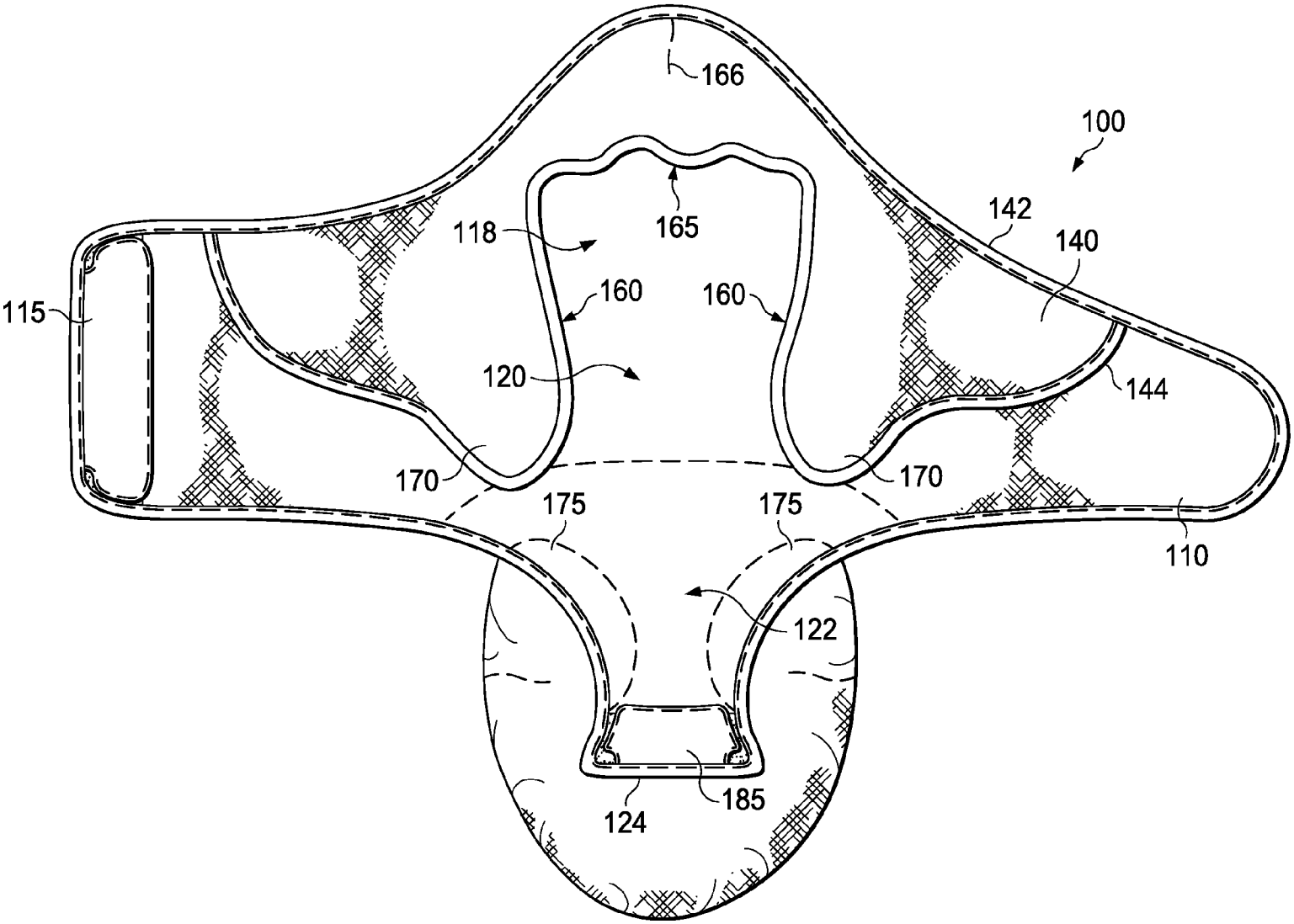
FIG. 1 depicts a front view of one embodiment of an ergonomic swaddling blanket.

The systems and methods and the various features and advantageous details thereof are explained more fully with reference to the nonlimiting embodiments that are illustrated in the accompanying drawings and detailed in the following description. Descriptions of well-known starting materials, processing techniques, components and equipment are omitted so as not to unnecessarily obscure the description in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus. Further, unless expressly stated to the contrary, "or" refers to an inclusive "or" and not to an exclusive "or". For example, a condition A or B is satisfied by any one of the following: A is true (or present) and B is false (or not present), A is false (or not present) and B is true (or present), and both A and B are true (or present).

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations include, but is not limited to: "for example," "for instance," "e.g.," "in one embodiment."

Swaddling is the practice of wrapping a baby in a blanket so that movement of the baby's limbs is restricted, though not necessarily eliminated. Embodiments described herein provide an ergonomic blanket for swaddling a child that allows a baby to be tightly wrapped. The swaddling blanket can have a "unitary but separate" design in which a unitary blanket allows separate swaddling of the arms/torso and lower body, including covering of the legs and providing proper hip positioning. A parent or caregiver does not need to loosen the entire swaddling blanket to change a diaper, check the baby's temperature, etc. Instead, the parent or caregiver is able to loosen only those portions of the swaddling blanket needed to access the baby's arms or legs or diaper.

Arm pockets may be provided that allow a baby's arms to be secured in a variety of bent arm positions. The swaddling blanket can include wraps proximate to the openings of arm pockets that wrap around the upper arm or above the elbow of the baby's arms to maintain the arms in the pockets and promote a bent arm position.

A hip positioner may also be provided that is configured to encourage the baby's hips, thighs or legs into a natural, ergonomic hip position, such as the "spread squat," "squat spread," "frog leg" or "frog" position. In the spread squat position (also known as the "frog leg", "frog" or "squat spread" position) the flexion at the hip joint is at least 90° and is preferably approximately 110° to 120° from the coronal plane, and the spreading angle should average at 35-55° from the median plane. This positions the femur heads correctly in the socket of the hip joint, or acetabulum. (The socket of the hip joint is the ilium's articular surface.) For newborns, no spreading is necessary and promoting hip flexion is sufficient (to reduce adduction and extension).

Figure 2:
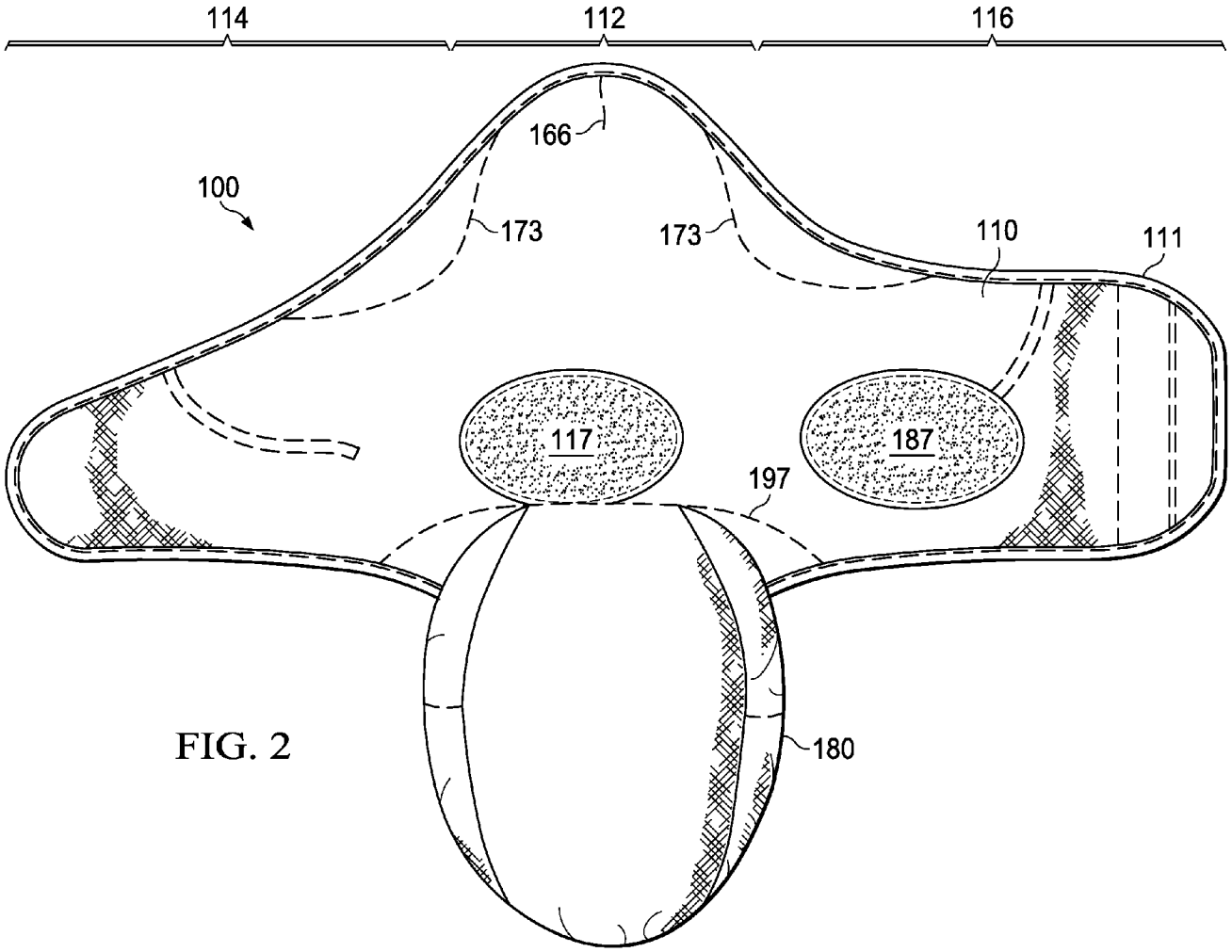
FIG. 2 depicts a rear view of one embodiment of an ergonomic swaddling blanket.

FIGS. 1 and 2 illustrate front and back views of one embodiment of swaddling blanket 100. Swaddling blanket 100 can include main panel 110 that has middle section 112, first arm wing 114 and second arm wing 116. Main panel 110 can be formed of one or more sub-panels of textile material sewn or otherwise joined together and may comprise one or more layers of material.

Middle section 112 provides a main receiving area having head portion 118 on which a baby's head rests, torso portion 120 that supports the baby's body and hip portion 122 that receives the baby's hips and includes hip positioning flap 124 that crosses between the baby's legs and positions the baby's hips and thighs. First arm wing 114 and second arm wing 116 extend laterally outward from middle section 112. Wings 114 and 116 may be asymmetrical or symmetrical. In some embodiments, the shape or dimensions of wings 114 and 116 may be complementary. Wings 114 and 116 having complementary shapes or dimensions may provide a desired ergonomic positioning without additional material that could add bulk or be uncomfortable for the baby. Arm pockets 160 can be disposed on wings 114 or 116. Wings 114 and 116 wrap across the baby's chest close to the body to gently secure the baby's arms with the baby's hands on his or her chest or in another position. The arm position gives the baby the feeling of security. The secure positioning also helps stop the newborn "startle reflex" and prevents the baby from scratching his face.

Preferably, at least one of arm wings 114 or 116 is long enough to wrap across the baby's chest and around the baby's back. According to the embodiment illustrated, for example, first arm wing 114 can wrap across the baby's body. Second arm wing 116 can wrap over first arm wing 114 to the back of the baby's body. Securing mechanism 115 such as hook and loop material can secure to a corresponding securing mechanism 117 on the back of main panel 110 to secure second arm wing 116. Securing mechanisms 115/117 can also include buttons, ties, snaps or other mechanisms. While only one wing 116 includes securing mechanism 115 in the embodiment of FIG. 1, securing mechanism 115 may be used to secure both wings 114 and 116 if desired. It can further be noted that first arm wing 114 can be relatively narrower than second arm wing 116, making it easier to wrap first arm wing 114 under second arm wing 116. It can also be noted that while first arm wing 114 is illustrated as the left arm wing and second arm wing 116 is illustrated as the right arm wing, the wings may be reversed or otherwise configured.

In addition to main panel 110, one or more additional panels formed of one or more pieces of material may be joined to main panel 110 to form swaddling blanket 100. For example, in the embodiment of FIG. 1, secondary panel 140 having outer edge 142 and inner edge 144 is joined to main panel 110. The back surface of secondary panel 140 faces the front surface of main panel 110. According to one embodiment, pockets 160 can be formed between secondary panel 140 and main panel 110.

All or portions of outer edge 142 of secondary panel 140 can be stitched or otherwise joined to main panel 110 proximate to a portion of outer edge 111 of main panel 110. In some embodiments, inner edge 144 of secondary panel 140 can be stitched to main panel 110 inward from main panel outer edge 111 to form the back side edges of an integrated hood 165 and along wings 114 and 116 to form the upper edges of first and second arm pockets 160. According to one embodiment, a single continuous stitch 173, visible in FIG. 2, can form a hood back side edge and upper arm pocket edges of each arm pocket 160.

Continuous inner edge 144 of secondary panel 140 can be joined to main panel 110 at a first portion and a second portion to form arm pockets 160 in cooperation with wings 114 and 116. A baby's arms can be received in the pockets 160 between the pocket forming portions of the secondary panel 140 and the main panel 110. According to one embodiment, arm pockets 160 do not extend the entire distance or width of wings 114 and 116, but are shorter and narrower than wings 114 and 116. Preferably, the size and configuration of pockets 160 is selected to minimize movement of the baby's arms. Each pocket 160 is open at a medial end (an end nearer the baby torso) and closed at the lateral end (an end away from the baby torso). In the embodiment shown in FIG. 1, for example, pockets 160 are closed where the outer edge of main panel 110 and edge 142 of secondary panel 140 are joined. In other embodiments, the pockets may be open at both ends.

One issue with swaddling babies is the possibility of them "escaping," such that their arms become free. If the arms are free, the baby can startle himself awake, scratch himself, etc. To prevent a baby from working his/her arms free, the arms may be maintained in pockets 160. An advantage to arm pockets 160 may be that the baby's arms are secured without over tightening the swaddling blanket.

In some embodiments, arm flaps can be provided. To this end, secondary panel 140 can include arm flap portions 170 located proximate to the opening of the arm pockets 160. Arm flap portions 170 can be used to more securely hold the baby's arms and can be inserted under each arm in pocket 160 to cover the baby's arm (or most of the baby's arm). Each arm flap may have a first portion where the baby's arm passes between the back surface of the arm flap and the front surface of the main panel and an arm wrap portion that tucks under a portion of the baby's arm.

According to one embodiment, arm flap 170 can be formed by extending the material of secondary panel 140 toward the center of the blanket from the pocket and in a direction that would be generally perpendicular (or other angle) to the baby's arm when the baby's arm is inserted in the corresponding arm pocket 160. In the embodiment illustrated, arm flap 170 extends generally downward and toward the midline of swaddling blanket 100 proximate to the arm pocket opening. Arm flap portions 170 can be of a sufficient length to provide an arm wrap portion that tucks under a portion of the baby's arm.

Figure 5:
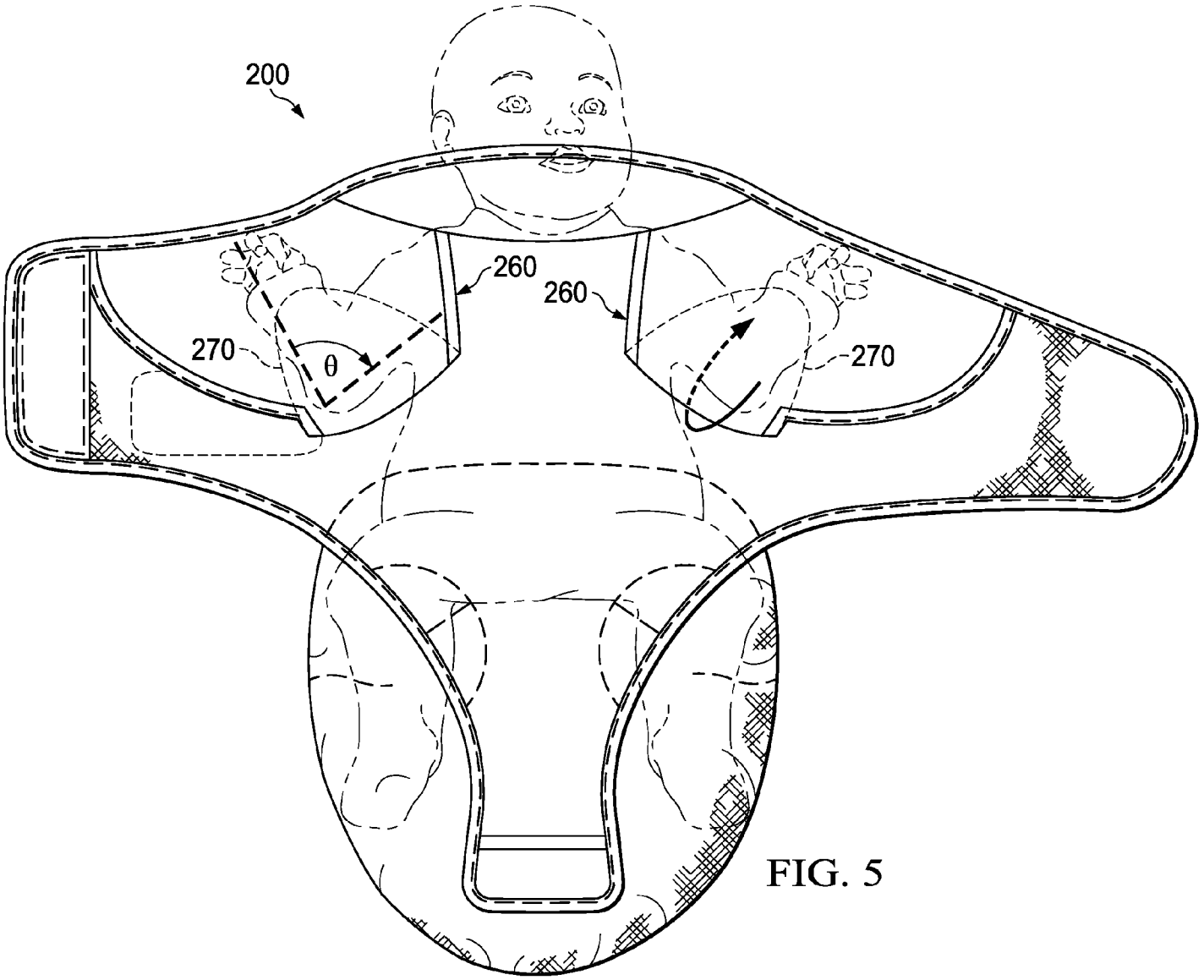
FIGS. 5 and 6 depict views of embodiments of a swaddling blanket, illustrating different arm positions.
Figure 6:
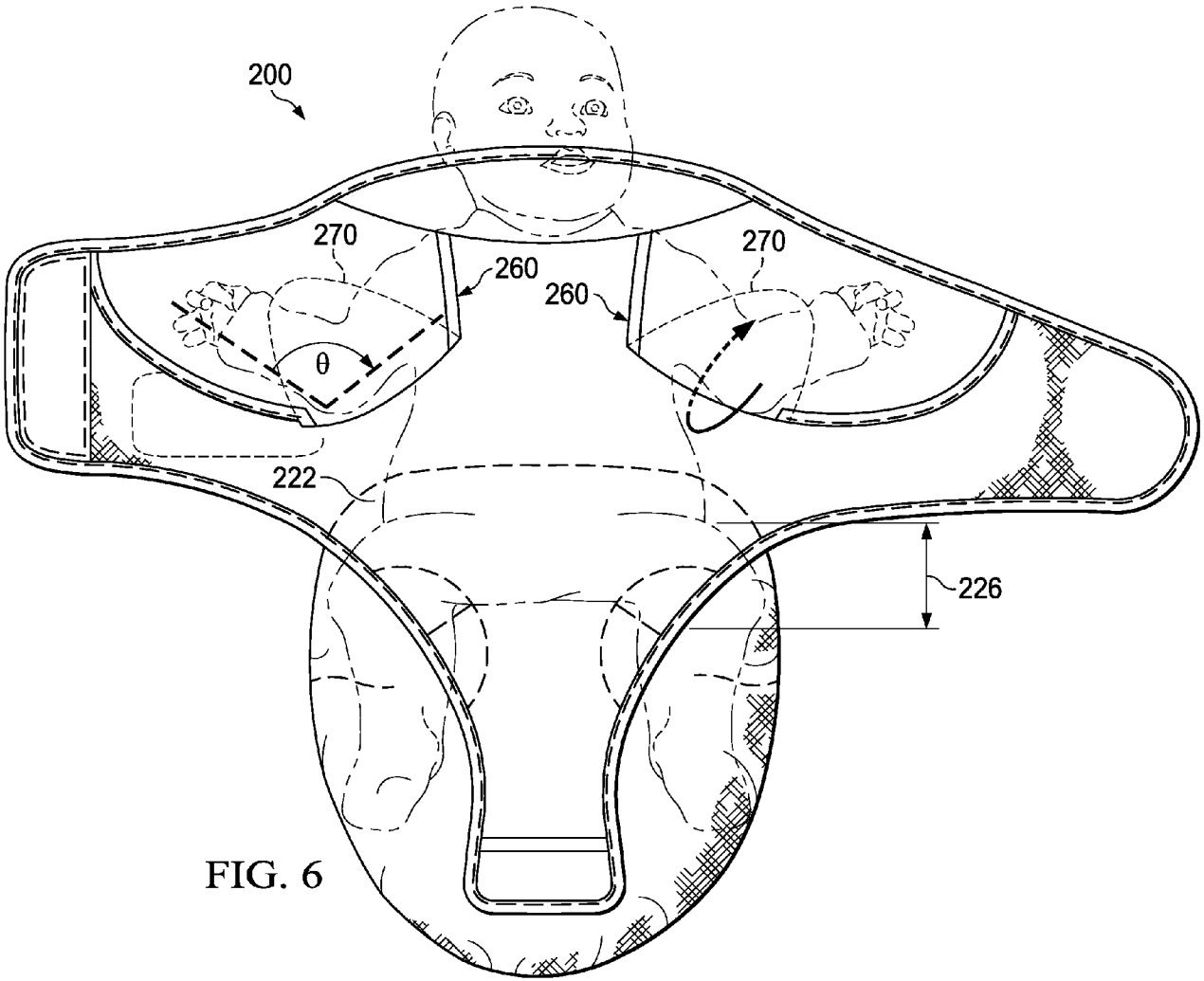

In operation, a portion of the baby's arm will be received in the arm pocket 160 and a portion will rest between arm flap 170 and main panel 110. The remainder of arm flap 170 can be tucked under the baby's arm so that arm flap 170 at least partially wraps an upper portion of the baby's arm. Arm flaps 170 help prevent the baby's arms from slipping out of arm pockets 160. FIGS. 5 and 6, discussed below, illustrate embodiments of arm pockets in more detail.

As noted above, one embodiment of a swaddling blanket can include an integrated hood 165. Hood 165 can be worn over the baby's head or folded back behind the baby's head. In the embodiment illustrated above, a portion of the inner edge of secondary panel 140 can be shaped to form an opening open to the head portion and torso portion. Tucking arm flap portions 170 under the baby's arms can help draw the inner edge closer to the baby's face. A sewn in dart 166 can provide a better, contoured fit around the baby's head. The integrated hood 165 eliminates heat loss from the baby's head, adds warmth and, unlike traditional swaddling blanket designs, prevents gaping at the nape of the neck.

Embodiments of the swaddling blanket can include a healthy hip positioner to encourage the baby's hips to a healthy position. For example, swaddling blanket 100 may include hip positioning flap 124, illustrated in a down position in FIG. 1. With hip positioning flap 124 in a down position, a baby may be easily positioned in swaddling blanket 100, a diaper may be changed, or the like. Hip positioning flap 124 can be configured to gently position and support a baby's delicate and still forming soft hip joints and pelvis in an ergonomic position by lifting and separating the baby's knees. It is believed that the more natural fetal position helps prevent hip dysplasia. Hip positioning flap 124 is wide enough to position the thighs so that the baby has bent knees and hips, allowing the hips to fall or spread naturally (e.g., into the spread squat position).

In some embodiments, hip positioning flap 124 encourages the baby's legs to a position so that the baby's hips are in a natural spread-squat position. The spread-squat position generally refers to a spreading of the knees, and a flexion of the hip, which may be coupled with a curvature of the spine. For newborn babies, little or no spreading of the knees may be desired, but curvature of the spine and flexion of the hips between 90 and 120 degrees may be desired. For older babies, hip positioning flap 124 may ensure flexion of the hip of at least 90 degrees and preferably 120 degrees, may further ensure spreading of the knees not to exceed 55 degrees, preferably 35-40 degrees (each leg), and may further promote rounding of the back. While hip positioning flap 124 may encourage the baby's hips to a natural position, it does not prevent the baby from moving and extending his/her legs when stretching or moving for some other reason.

Contoured padding on either side of hip positioning flap 124 can give medial support to the upper thighs, yet allows a baby to have some freedom of movement and encourage legs to return back to a natural fetal position. In particular, areas of increased padding 175 can be placed on areas of hip positioning flap 124 that contact the baby's thighs. Padding 175 may also be used to prevent the baby's legs from folding up.

According to one embodiment, swaddling blanket 100 is shaped so that the baby's bottom rests on a portion of hip portion 122. Hip portion 122 can be dimensioned to be wider than the baby's hips. Additionally, hip positioning flap 124 remains wider than the baby's hips for a portion of hip positioning flap 124 that contacts the back of the baby's thighs below the buttocks. Hip positioning flap 124 can taper inward to be narrower than the baby's hips at an area further down the baby's thighs, allowing hip positioning flap 124 to pass between the baby's legs. Preferably, hip positioning flap 124 remains wide enough so that when the distance between the baby's legs narrows (e.g., due to the baby straightening his legs), the baby's thighs press against hip positioning flap 124 such that hip positioning flap 124 encourages the baby's thighs to separate.

Hip positioning flap 124 may include a securing mechanism 185 to secure the end portion of hip positioning flap 124 to swaddling blanket when hip positioning flap 124 is in a secure position. According to one embodiment, hip positioning flap 124 may include a hook and loop securing mechanism 185 that secures to a hook and loop securing mechanism 187 on the back of second wing 116. Other securing mechanism may also be used. It can be noted that hip positioning flap 124, in the embodiment, illustrated, can be unsecured without unswaddling the baby's torso. However, securing hip positioning flap 124 when the baby's legs are uncovered anchors the swaddle of the upper torso, helping prevent the upper portion of the swaddling blanket from riding up the baby's torso if the baby moves.

A leg pouch 180 may be joined to the main panel and can be used to provide additional warmth for the baby's legs and feet. According to one embodiment, leg pouch 180 may be sewn or otherwise joined to main panel 110, shown for example at stitching line 197. Leg pouch 180 can provide additional warmth and leg security, while allowing from freedom of leg movement. However, according to one embodiment, leg pouch 180 is not designed to support the baby's legs or encourage the baby's legs to rest in any specific position. Instead, the baby's legs are urged toward a natural position by hip positioning flap 124. An elastic opening can allow the caregiver easy access when putting the baby's legs inside and the elastic top may also gently hug across the baby's tummy. It can be noted that, in the embodiment illustrated, the baby's legs may be removed from pouch 180 without unsecuring hip positioning flap 124 or loosening the swaddle on the baby's arms. Thus, the baby's legs can be uncovered (e.g., for comfort, application of ointment or other purpose) without disturbing the integrity of the hip positioner or the swaddle of the baby's arms.

Swaddling blanket 100 can be dimensioned so that the baby's head rests on head portion 118 and the baby's hips rest on hip portion 122. Because babies vary in size, swaddling blanket 100 can be sized to accommodate an average size baby and a range of sizes thereabouts. For example, swaddling blanket 100 can be sized to accommodate a 1 month old in the $50^{th}$ height percentile (and a range of heights, e.g., +−10%, 20%, 30%, 40%), a 2 month old in the 50th height percentile (and a range of heights, e.g., +−10%, 20%, 30%, 40%), a 3 month old in the $50^{th}$ height percentile (and a range of heights e.g., say +−10%, 20%, 30%, 40%), etc. Because swaddling blanket 100 can accommodate a range of sizes for babies of varying sizes and ages, swaddling blanket 100 may be sized to accommodate a baby through a range of ages. Furthermore, swaddling blankets 100 of different sizes may be used to accommodate babies in different size ranges, including smaller swaddling blankets 100 for premature babies and larger swaddling blankets 100 for larger babies. For example, in some embodiments, swaddling blanket 100 may be sized for children between 3-6 months, or may be sized to accommodate children between 20-30 pounds.

Figure 3:
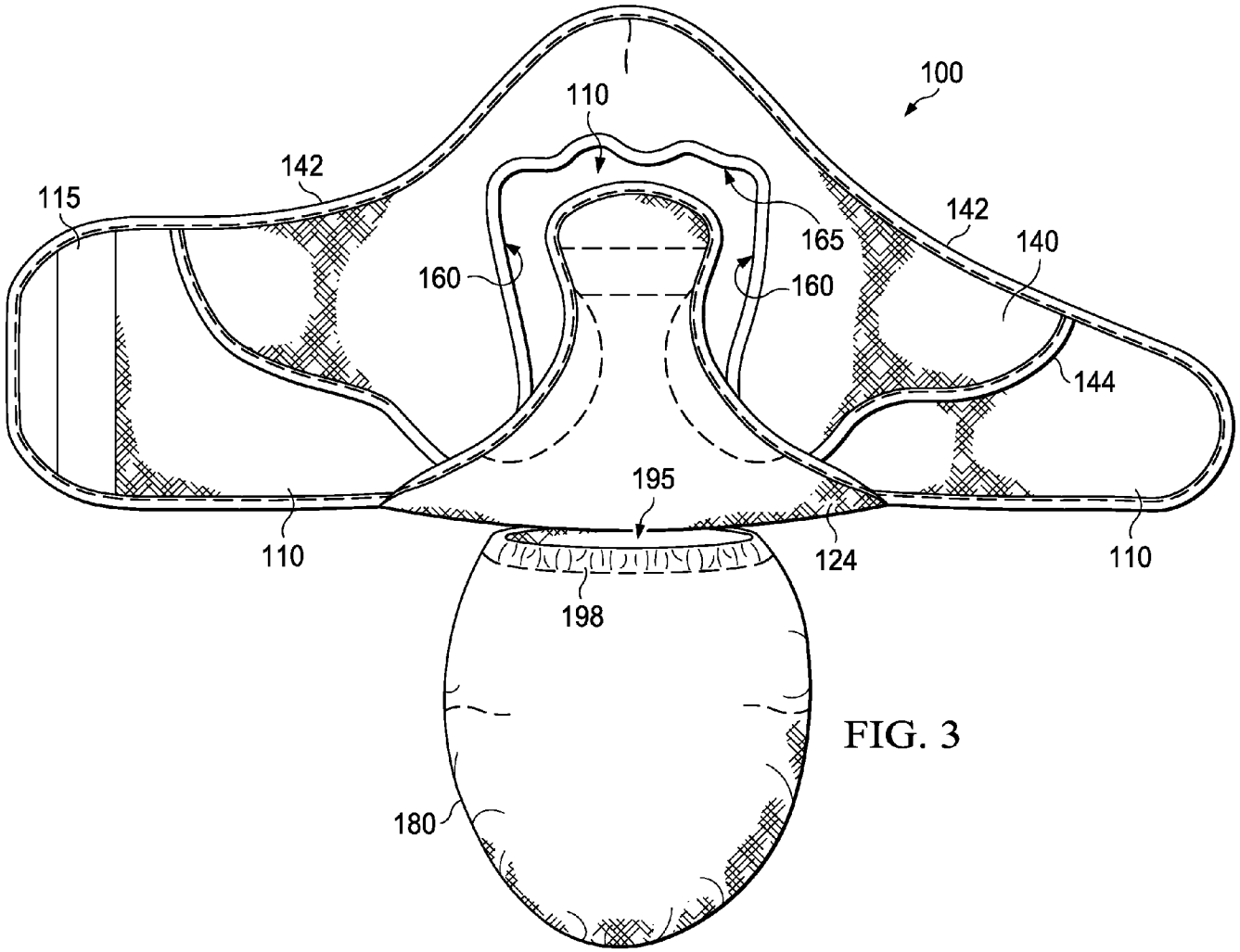
FIG. 3 illustrates another view of an ergonomic swaddling blanket with the hip flap raised.

FIG. 3 illustrates a front view of swaddling blanket 100 with hip flap 124 raised to reveal pouch 180. Sewn in darts 190 on pouch 180 allow for freedom of movement. Pouch 180 may have an opening 195 at a top end of the pouch. Opening 195 may be surrounded by elastic 198.

Figure 4:
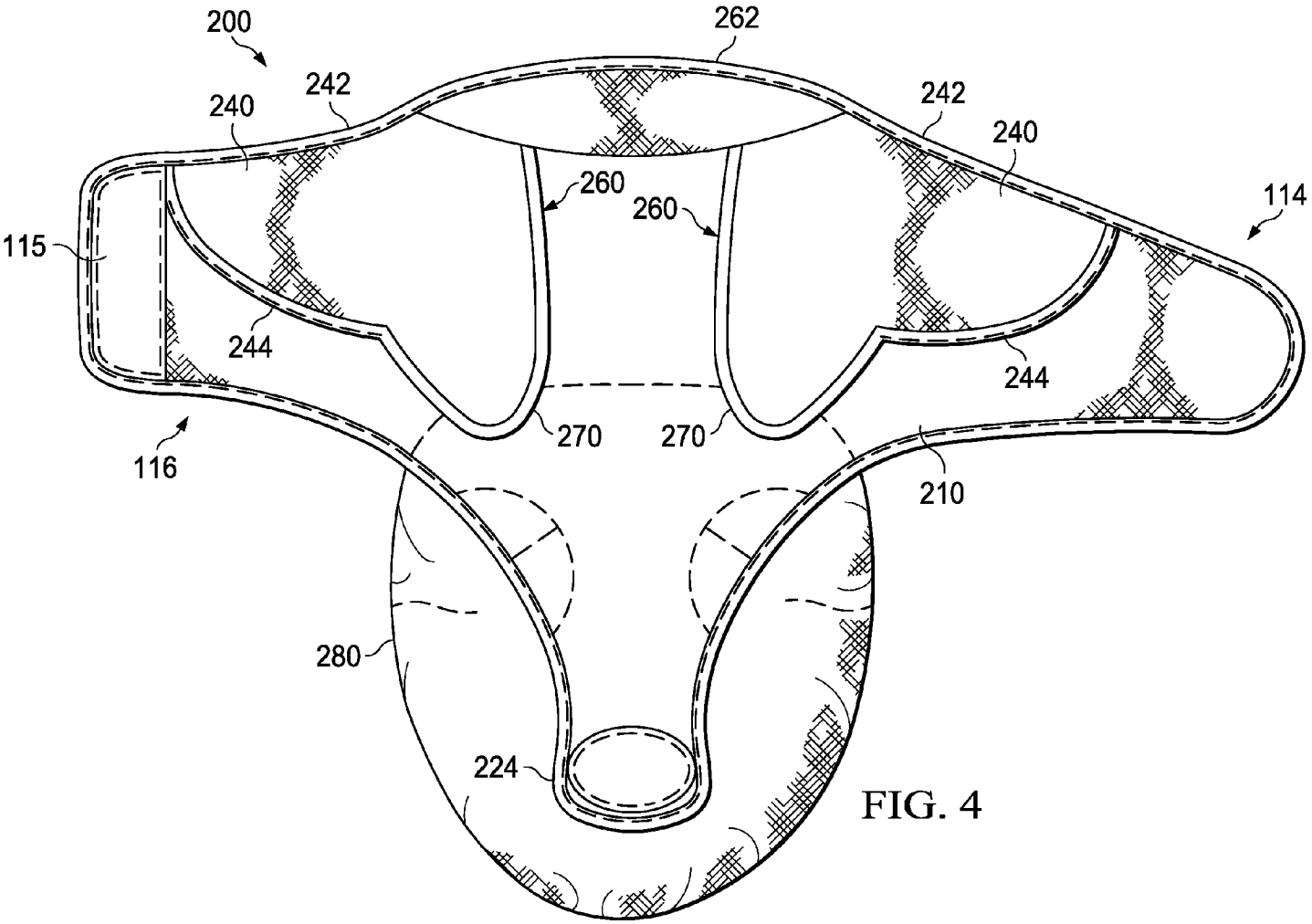
FIG. 4 depicts a front view of another embodiment of an ergonomic swaddling blanket.

FIG. 4 depicts a front view of one embodiment of swaddling blanket 200. Swaddling blanket 200 depicted in FIG. 4 can include similar features including arm pockets 260, a hip positioner 224 and pouch 280 as discussed above in conjunction with other embodiments except that an integrated hood is not provided and the baby's neck can rest on collar area 262.

Some embodiments, such as swaddling blanket 200 depicted in FIG. 4, include a main panel 210 and can include first and second secondary panels 240. Each of main panel 210 and the secondary panels may be formed of multiple pieces of material. All or a portion of the outer edge 242 of each secondary panel 240 can be joined to the main panel 210 at or proximate to the outer edge of the main panel to form a top edge of an arm pocket 260 and a portion of the inner edge 244 of secondary panel(s) 240 can be joined to the main panel 210 to form a bottom edge of an arm pocket 260. Additional stitching can complete the upper edges of the arm pockets. For example, a single continuous stitch is shown in FIG. 4 as completing the upper edge of the left and right arm pockets. The arm pockets 260 can have openings on medial end (the end nearer the baby's torso) to receive the baby's arms and closed or open on a distal side.

Arm flaps 270 can be provided proximate to the openings to the arm pockets. Each arm flap may have a first portion where the baby's arm passes between the back surface of the arm flap and the front surface of the main panel and an arm wrap portion that tucks under a portion of the baby's arm. In the embodiment illustrated, arm flap 270 extends generally downward and toward the midline of swaddling blanket 200 proximate to the arm pocket opening. Arm flap portions 270 can be of a sufficient length so that they can tuck under an upper portion of the baby's arm not already received in arm pocket 260. According to one embodiment, each arm flap can be formed by a portion of the corresponding secondary panel 240 that is not stitched along the medial and inner edges.

In operation, a portion of the baby's arm will be received in the arm pocket 260 and a portion will rest between arm flap 270 and main panel 210. The remainder of arm flap 270 can be tucked under the baby's arm so that arm flap 270 at least partially wraps an upper portion of the baby's arm. Arm flaps 270 help prevent the baby's arms from slipping out of arm pockets 260.

Because babies vary in size, swaddling blanket 200 can be sized to accommodate an average size baby and a range of sizes thereabouts. For example, swaddling blanket 200 can be sized to accommodate a 1 month old in the $50^{th}$ height percentile (and a range of heights, e.g., +−10%, 20%, 30%, 40% and greater or lesser heights), a 2 month old in the 50th height percentile (and a range of heights, e.g., +−10%, 20%, 30%, 40% and greater or lesser heights), a 3 month old in the $50^{th}$ height percentile (and a range of heights e.g., say +−10%, 20%, 30%, 40% and greater or lesser heights), etc. Because swaddling blanket 200 can accommodate a range of sizes for babies of varying sizes and ages, swaddling blanket 200 may be sized to accommodate a baby through a range of ages. Furthermore, swaddling blankets 200 of different sizes may be used to accommodate babies in different size ranges, including smaller swaddling blankets 200 for premature babies and larger swaddling blankets 200 for larger babies. For example, in some embodiments, swaddling blanket 200 may be sized for children between 3-6 months, or may be sized to accommodate children between 20-30 pounds.

FIGS. 5 and 6 depict views of embodiments of swaddling blanket 200, illustrating that the arm pockets 260 and arm flaps 270 can accommodate a variety of bent arm positions. As depicted in FIGS. 5 and 6, a baby may be positioned in swaddling blanket 200 and the baby's arms may be positioned in the preformed pockets 260, with the baby's arms having an angle Θ (Theta). For newborns, theta may be less than 90 degrees. For older babies, theta may be greater than 90 degrees. The choice of theta may vary depending on the age of the baby and in what position the baby feels more comfortable. Arm flaps 270 are provided that include arm wrap portions that wrap around a portion of the baby's arm, including a portion of the upper arms, and tuck under the baby's arms and into the pockets. Each arm flap 270 applies a gentle upward and lateral force to the baby's upper arm to maintain the baby's arm in the respective pocket 260 in a bent arm position. The skilled artisan would understand that the pockets and arm wraps can be incorporated in any suitable form factor of swaddling blanket, including blankets with our without wings. By way of example, but not limitation, pockets and arm wraps as discussed above can be incorporated on a large rectangular blanket or other shaped blanket.

Further as illustrated in FIG. 6, the hip area 222 has a portion 226 that is wider than the baby's hips where the baby's hips rest on the blanket. Hip positioning flap remains wider than the baby's hips along a portion of the thighs. Hip positioning flap then tapers to be slightly narrower than the baby's hips. The skilled artisan would understand that the hip positioner can be incorporated in any suitable form factor of swaddling blanket.

Figure 7:
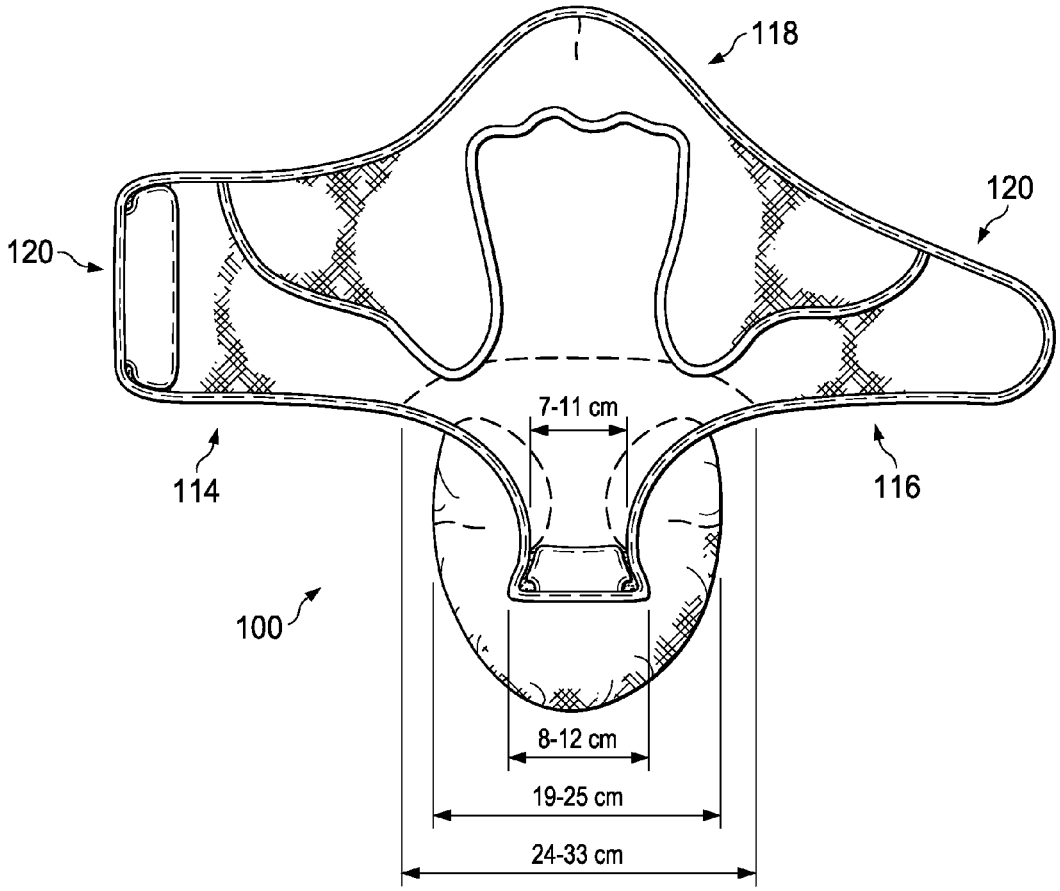
FIG. 7 depicts a front view of one embodiment of a swaddling blanket, illustrating a range of some example dimensions.

While the swaddling blankets are not limited to particular dimensions or ranges of dimensions and may be sized to accommodate an occupant of any size, FIG. 7 depicts a front view of one embodiment of swaddling blanket 100, illustrating some example dimensions (and ratios of dimensions) for swaddling babies. The dimensions of portions of swaddling blanket 100 that provide positioning for a baby's thighs may vary to accommodate children of certain ages or sizes. For example, hip area 122 may be 24-35 cm and taper to hip positioning flap 124 having padding to position or support a baby's thighs. In one embodiment, hip positioning flap may taper to between 7-11 cm, but will remain wider than the baby's hips for a portion of hip positioning flap 124 that runs across the back of the baby's thighs. In the embodiment illustrated, for example, the width of the hip flap in the area of padding may transition from a width of approximately 19-25 cm to a width of 8-12 cm.

The dimensions provided in FIG. 7 are provided by way of example, but not limitation. The skilled artisan would understand that dimensions that are higher or lower than the example ranges may be used to accommodate various sizes of babies and may be made large enough or small enough to accommodate any size occupant as needed. For example, in some embodiments, hip area 122 may be less than 24 cm or greater than 35 cm and the hip positioning flap may taper to less than 7 cm or to a size greater than 11 cm in order to accommodate the occupant while still providing hip positioning. Furthermore, other aspects of the swaddling blanket may be appropriately sized to accommodate various sized occupants.

Figure 8:
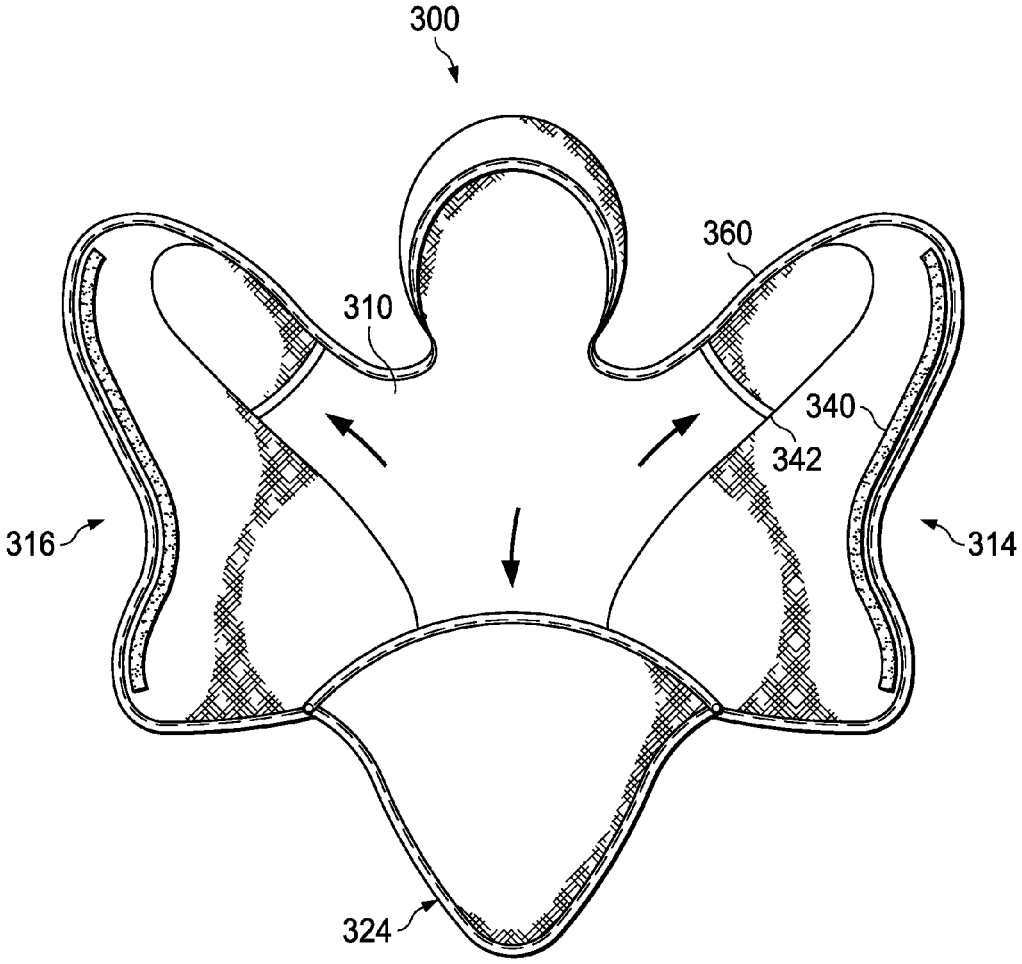
FIG. 8 depicts a front view of one embodiment of an ergonomic swaddling blanket in a butterfly shape.

FIG. 8 depicts a front view of one embodiment of ergonomic swaddling blanket 300 having sewn in arm sleeves 360 and in which left and right arm wings 314 and 316 are generally symmetric and the overall shape resembles a "butterfly" shape. In this configuration, sleeves 360 can maintain the baby's arms at an angle relative to the body, and edge 342 of secondary panel 340 prevents the baby's arms from bending. Hood 365 may be formed separately from pockets 360. Furthermore, hook and loop material 115 may extend along the length of either or both wings 314 and 316 to fasten wings 314 and 316 to each other or main panel 310. Hip positioning flap 324 may fold up from underneath between the baby's legs and snap or otherwise fasten to main panel 310.

Figure 9:
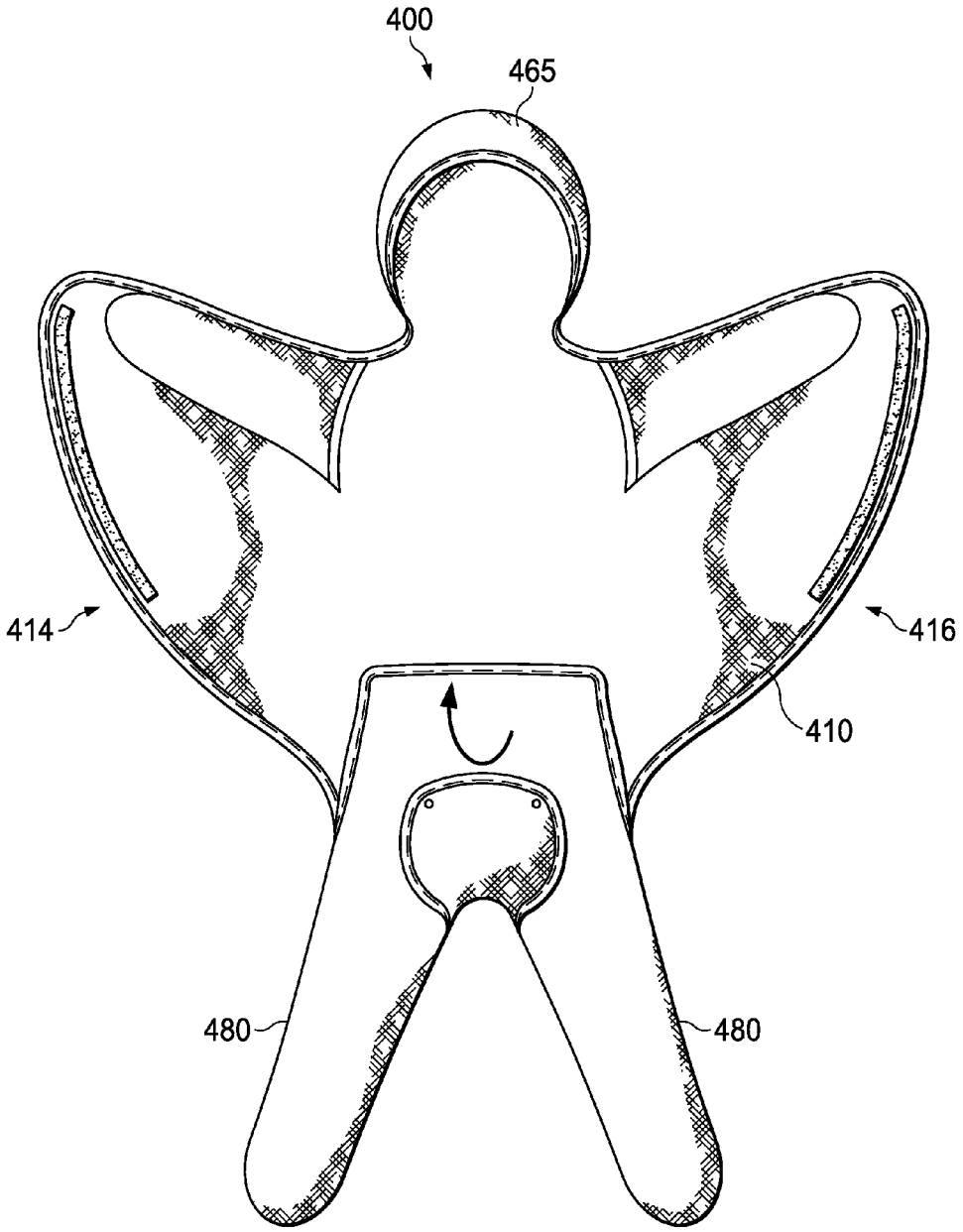
FIGS. 9 and 10 depict front views of one embodiment of an ergonomic swaddling blanket in an open and closed configuration.
Figure 10:
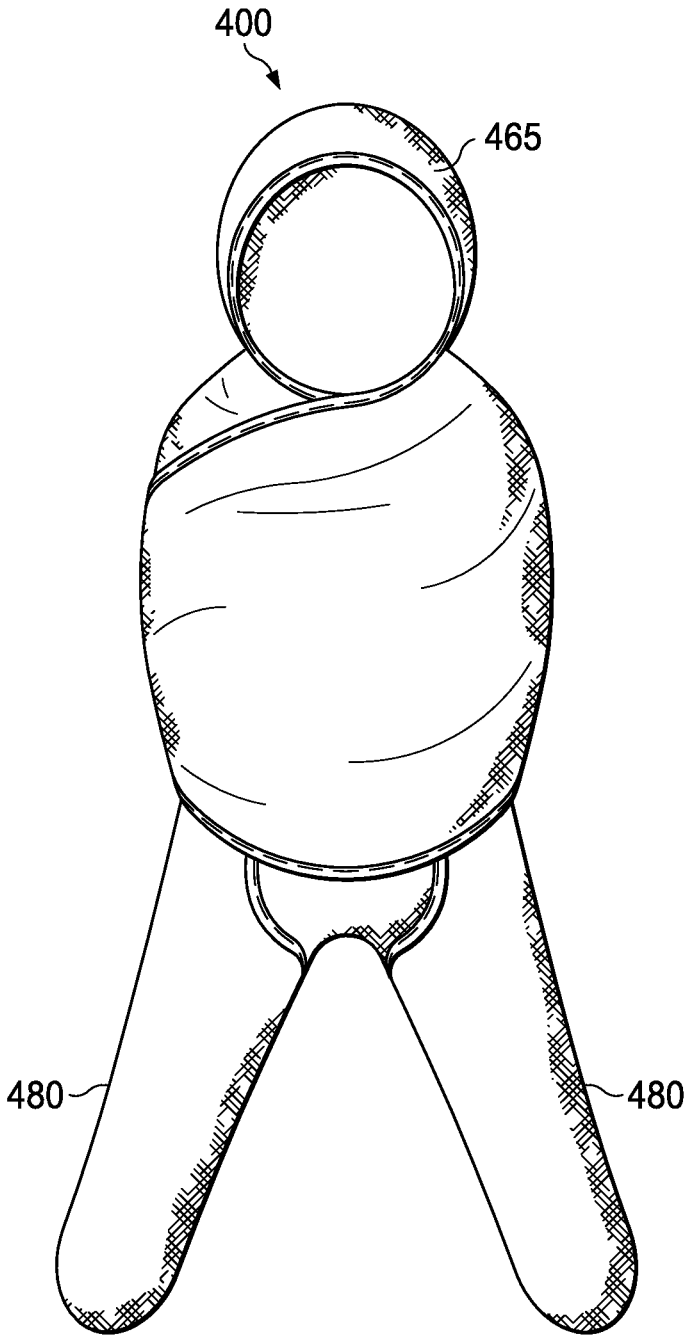

FIGS. 9 and 10 depict a front view of one embodiment of ergonomic swaddling blanket 400 in which arm pockets 460 may be sewn to restrict movement of a baby's arms relative to main panel 410. Main panel 410 may also be shaped with first and second arm wings 414 and 416 being symmetrical, and further having an "angel wing" shape. Hood 465 may be formed separately from pockets 460. Ergonomic swaddling blanket 400 may include leggings 480 in which the baby's legs are not contained in a single pouch but separate legs. Separate legs of leggings 480 may be easier for positioning a baby in a carrier, allowing a strap to be passed through the baby's legs, may be easier for changing diapers, or the like.

Figure 11:
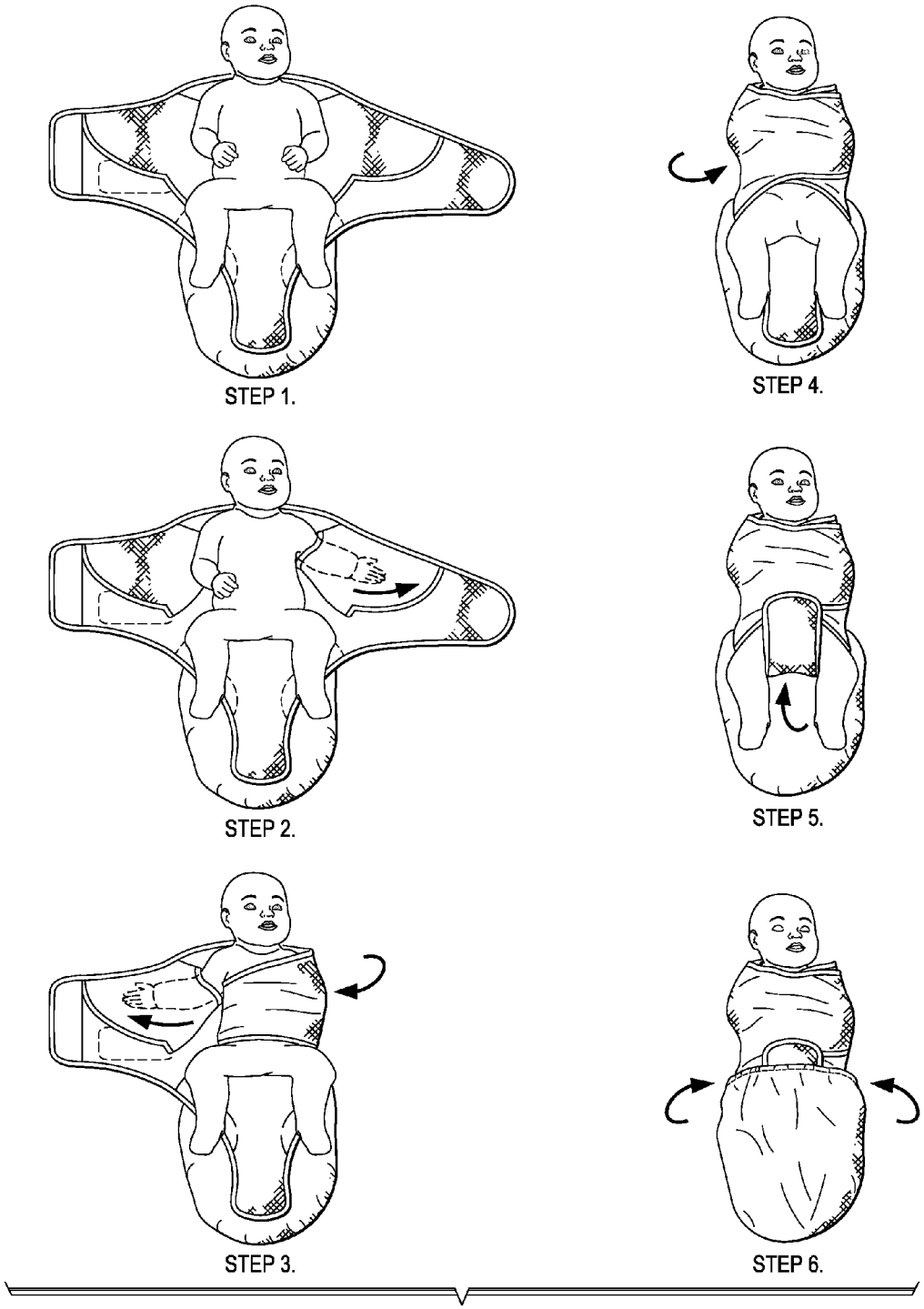
FIG. 11 depicts various stages in a process for swaddling a baby using one embodiment of an ergonomic swaddling blanket.

FIG. 11 depicts a series of views illustrating one method for implementing a swaddling blanket on an baby. In step 1, the baby is positioned in the ergonomic swaddling blanket. Positioning the baby may include ensuring the baby's hips are positioned relative to a contoured seating area, a hip positioning flap, or the like. In steps 2-4, the baby's arms can be positioned in arm pockets in wings and the wings secured to the torso portion of the swaddling blanket. As depicted in steps 2-4, the baby's left arm is secured before the right arm. However, either arm may be secured first. In step 5, a hip positioning flap may be advanced between the baby's legs and attached to the torso portion of the swaddling blanket. Optionally, in step 6, the baby's legs may be encased in a leg pouch for added warmth or protection for the legs.

The material of which the swaddling blanket is formed can have some stretch so that the baby can stretch his legs while the hip positioning flap provides sufficient support to urge the baby's thighs back into a bent hip and knee position. The blanket can be a soft, pliant blanket. In some embodiments, a jersey knit may provide sufficient comfort and stretch for a baby in the swaddling blanket while still allowing the baby to feel secure and warm. Other materials include, but are not limited to, cotton (including muslin), fleece and spandex. Other natural and synthetic fibers may be possible, including knits and weaves.

Although the invention has been described with respect to specific embodiments thereof, these embodiments are merely illustrative, and not restrictive of the invention. The description herein of illustrated embodiments is not intended to be exhaustive or to limit the invention to the precise forms disclosed herein (and in particular, the inclusion of any particular embodiment, dimensions, feature or function is not intended to limit the scope to such embodiment, feature or function). Rather, the description is intended to describe illustrative embodiments, features and functions in order to provide a person of ordinary skill in the art context without limiting the invention to any particularly described embodiment, feature or function. While specific embodiments and examples are described herein for illustrative purposes only, various equivalent modifications are possible within the spirit and scope of this disclosure, as those skilled in the relevant art will recognize and appreciate. As indicated, these modifications may be made in light of the foregoing description of illustrated embodiments and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Reference throughout this specification to "one embodiment," "an embodiment," or "a specific embodiment" or similar terminology means that a particular feature, structure, or characteristic described in connection with the embodiment is included in at least one embodiment and may not necessarily be present in all embodiments. Thus, respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

Furthermore, the characterization of any feature as "optional" herein is provided by example and is not intended to and should not be read to imply that other features not characterized as optional are not also optional in various embodiments.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

What is claimed is:

1. A swaddling blanket, comprising:

a middle section, the middle section having a torso portion and a hip portion;

a first arm wing extending a first direction from the middle section; and a second arm wing extending a second direction from the middle section;

a hip positioning flap configured to encourage a baby to an ergonomic position when in use by lifting and separating the baby's thighs;

a leg pouch;

a first pocket disposed on the first wing, the first pocket having a first pocket opening at a medial end of the first pocket, the first pocket adapted to receive a first arm;

a second pocket disposed on the second wing, the second pocket having a second pocket opening at a medial end of the first pocket, the second pocket adapted to receive a second arm;

a first arm flap proximate to the first pocket opening, the first arm flap further comprising:

a first arm flap first portion having a back surface facing a front surface of the first arm wing such that the first arm passes between the first arm flap first portion and the front surface of the first wing when the first arm is received in the first pocket; and a first arm wrap portion extending from the first portion, the first arm wrap portion adapted to tuck under a portion of the first arm when the first arm is received in the first pocket; and a second arm flap proximate the second pocket opening, the second arm flap comprising:

a second arm flap first portion having a back surface facing a front surface of the second arm wing such that the second arm passes between the second arm flap first portion and the front surface of the second wing when the second arm is received in the second pocket; and a second arm wrap portion extending from the second arm flap first portion, the second arm wrap portion adapted to tuck under a portion of the second arm when the second arm is received in the second pocket.

2. The swaddling blanket of claim 1, wherein the first arm wing and the second arm wing are asymmetrical and complementary.

3. The swaddling blanket of claim 1, wherein the first arm wing is adapted to wrap around the baby and the second arm wing is adapted to wrap over the first arm and secure to the swaddling blanket.

4. A swaddling blanket comprising:

a middle section to receive a baby's torso;

a first arm wing extending in a first direction from the middle section;

a second arm wing extending in a second direction from the middle section;

a first pocket disposed on the first wing, the first pocket having a first pocket opening at a medial end of the first pocket, the first pocket adapted to receive a first arm in a bent arm position;

a second pocket disposed on the second wing, the second pocket having a second pocket opening at a medial end of the first pocket, the second pocket adapted to receive a second arm in a bent arm position;

a first arm flap proximate to the first pocket opening, the first arm flap further comprising:

a first arm flap first portion having a back surface facing a front surface of the first arm wing such that the first arm passes between the first arm flap first portion and the front surface of the first wing when the first arm is received in the first pocket; and a first arm wrap portion extending from the first portion, the first arm wrap portion adapted to tuck under a portion of the first arm when the first arm is received in the first pocket;

a second arm flap proximate the second pocket opening, the second arm flap comprising:

a second arm flap first portion having a back surface facing a front surface of the second arm wing such that the second arm passes between the second arm flap first portion and the front surface of the second wing when the second arm is received in the second pocket; and a second arm wrap portion extending from the second arm flap first portion, the second arm wrap portion adapted to tuck under a portion of the second arm when the second arm is received in the second pocket.

5. The swaddling blanket of claim 4, wherein the first arm wing is adapted to wrap around the baby and the second arm wing is adapted to wrap over the first arm and secure to the swaddling blanket.

6. The swaddling blanket of claim 4, wherein the second arm wing comprises a securing mechanism located proximate to the tip of the second arm wing.

7. The swaddling blanket of claim 4, further comprising:

a main panel; and a first secondary panel having a first secondary panel back surface facing a main panel front surface, the first secondary panel forming the first pocket in cooperation with the main panel.

8. The swaddling blanket of claim 7, wherein the first secondary panel forms the second pocket in cooperation with the main panel.

9. The swaddling blanket of claim 8, wherein the first arm flap and second arm flap comprise portions of the first secondary panel.

10. The swaddling blanket of claim 7, further comprising a second secondary panel having a second secondary panel back surface facing the main panel front surface, the second secondary panel forming the second pocket in cooperation with the main panel.

11. The swaddling blanket of claim 10, wherein the first arm flap comprises a portion of the first secondary panel and the second arm flap comprises a portion of the second secondary panel.

12. The swaddling blanket of claim 4, further comprising a hip positioning flap configured to encourage a baby to an ergonomic position when in use by lifting and separating the baby's thighs.

13. The swaddling blanket of claim 4, further comprising a leg pouch.

14. The swaddling blanket of claim 12, wherein the hip positioning flap is adapted to secure to a back of the second arm wing independent of securing the second arm wing.

15. The swaddling blanket of claim 13, wherein the leg pouch is configured to allow the baby's legs to be uncovered.

16. The swaddling blanket of claim 12, wherein the hip positioning flap is wider than the baby's hips for a portion along the baby's thighs.

17. The swaddling blanket of claim 16, wherein the hip positioning flap comprises areas of increased padding.

18. The swaddling blanket of claim 17, wherein the areas of increased padding comprise a first area of increased padding at a first edge of the hip positioning flap in a first thigh contact area and a second area of increased padding at a second edge of the hip positioning flap in a second thigh contact area.

* * * * *